United States Patent [19]

Baugus

[11] Patent Number: 4,802,298

[45] Date of Patent: Feb. 7, 1989

[54] GUN CYLINDER LOCK DEVICE

[76] Inventor: Donald G. Baugus, 1139 Terrell St., Mebane, N.C. 27302

[21] Appl. No.: 179,635

[22] Filed: Apr. 8, 1988

[51] Int. Cl.[4] ..... F41C 27/00

[52] U.S. Cl. ..... 42/70.11; 42/66; 42/67

[58] Field of Search ..... 42/66, 67, 70.11

[56] References Cited

U.S. PATENT DOCUMENTS

| | | | |
|---|---|---|---|
| 2,327,334 | 8/1943 | Parker | 42/1 |
| 2,887,807 | 5/1959 | Santangelo | 42/1 |
| 2,943,411 | 7/1960 | Salva | 42/66 |
| 2,997,802 | 8/1961 | Robbins | 42/1 |
| 3,022,598 | 2/1962 | Wikstrom | 42/66 |
| 3,027,674 | 4/1962 | Mahan | 42/66 |
| 3,085,360 | 4/1963 | Robbins et al. | 42/66 |
| 3,360,880 | 1/1968 | Finnegan . | |
| 4,048,741 | 9/1977 | Chiodo et al. . | |
| 4,092,794 | 6/1978 | Moren . | |
| 4,461,108 | 7/1984 | Von Muller . | |

*Primary Examiner*—Deborah L. Kyle
*Assistant Examiner*—Richard Klein

[57] ABSTRACT

A light weight readily adaptable plastic device to stop rotation of the cylinder of a revolver is presented having an arcuate pawl which contacts the gun frame as rotation of the cylinder is attempted, for example, by pulling the trigger. The device includes a semi-hexagonally shaped pawl with a pair of depending cylinder studs which will engage two of the shell chambers in a gun cylinder and which will allow shells to occupy the remaining chambers.

9 Claims, 2 Drawing Sheets

GUN CYLINDER LOCK DEVICE

BACKGROUND OF THE INVENTION

1. Field Of The Invention

The invention herein pertains to a gun safety device and particularly to a safety device for a gun having a revolving shell chamber cylinder.

2. Description Of The Prior Art And Objectives Of The Invention

Various safety devices and firearm locks have been developed in the past for use with rifles, pistols and other guns. Many of the prior art devices rely on the gun being empty as intended for the devices to fit or work to insure that the gun is empty and safe during handling. For example, the Robbins et al safety device as seen in U.S. Pat. No. 3,085,360 demonstrates a cylinder cover which when in place will insure that shells are not in the cylinder chambers. Devices of this type are useful, however many gun owners prefer to keep their gun partially loaded for a quick response when needed, but want to insure that the gun will not accidentally be fired by small children or other inexperienced persons without certain steps being taken to remove the precautionary device.

For this reason and for other shortcomings realized with prior art devices and methods, the present invention was conceived and one of its objectives is to provide a fool-proof, simply constructed device which can easily be inserted into a gun cylinder to prevent the gun from firing, yet which will allow several of rounds or shells to be kept in the cylinder simultaneously therewith.

It is another objective of the present invention to provide a cylinder lock device for a revolver which can quickly be removed from the cylinder so in an emergency the gun can readily be fired.

It is still another objective of present invention to provide a cylinder lock device which is relatively small and therefore can be conveniently carried in a pocket or the like.

It is also an objective of the present invention to provide a cylinder lock device which has a substantially semi-hexagonally shaped planar pawl which is joined to a pair of cylindrically shaped chamber studs which, when the device is in place in a gun cylinder the cylinder will only partially rotate due to the semi-hexagonally shaped pawl and therefore the gun will not fire until the device is removed from the cylinder.

SUMMARY OF THE INVENTION

The present invention comprises a safety device for guns and specifically a safety device for use with guns that employ a rotating shell cylinder such as revolvers or the like. The invention consists of a cylinder lock device for a revolver which includes an arcuate pawl that contacts the gun frame and prevents adequate rotation of the cylinder if firing is attempted. The semi-hexagonally shaped pawl will not allow the cylinder to sufficiently rotate either in a clockwise or counter clockwise direction, depending on the particular gun, to allow it to fire. The cylinder studs comprise cylindrically shaped members which are elongated to extend into the shell chambers and it has been found that two (2) such cylinder studs are sufficient. Thus, in a revolver having six (6) shell chambers, four (4) chambers can be kept loaded with live shells and with the invention in place, the gun can be rendered safe until such time as the lock device is removed therefrom.

DESCRIPTION OF THE PREFERRED EMBODIMENT

Figure 1:
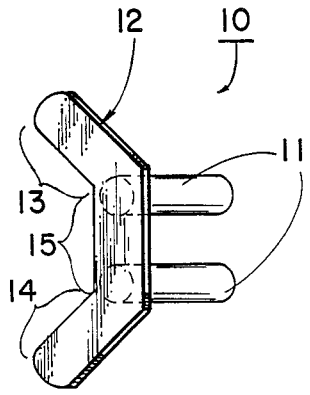
FIG. 1 demonstrates a perspective view of the cylinder lock device of the invention.
Figure 2:
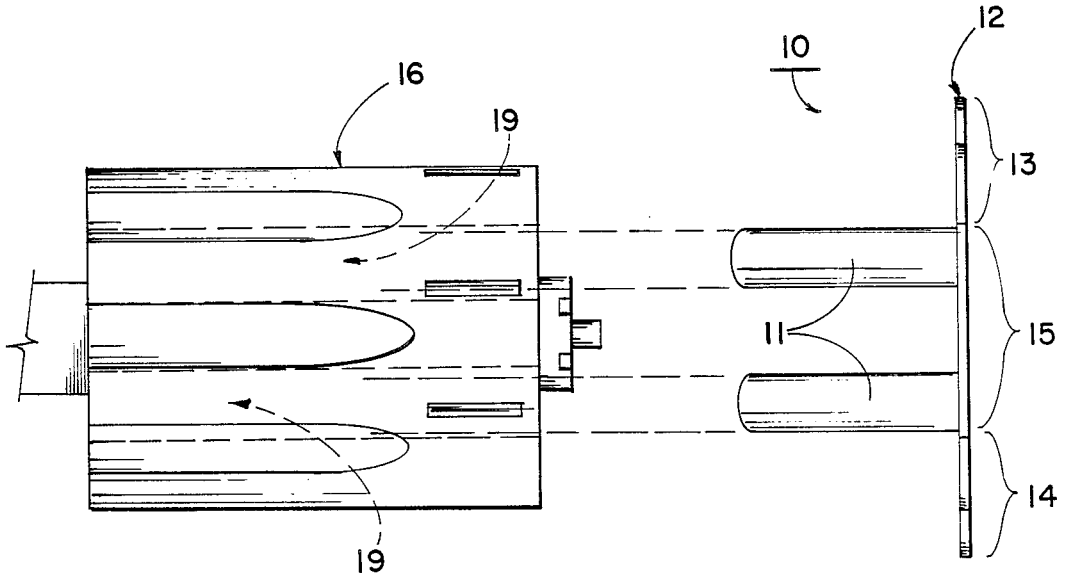
FIG. 2 shows a side elevational view of a gun cylinder with the cylinder lock device removed therefrom.

The preferred form of the invention is shown in FIG. 1 in which the gun cylinder lock device includes a pair of the elongated cylindrical studs attached on one side of a semi-hexagonally shaped planar pawl. In FIG. 2 the arcuate pawl is shown sized so when the cylinder studs are in separate shell chambers, if the gun is attempted to be fired, the pawl will rotate thus striking the gun frame and preventing adequate cylinder rotation and firing regardless of the particular rotational direction of the specific gun cylinder. The device may be made from a durable inexpensive plastic such as polyethylene and may be molded to various sizes for different caliber and dimensioned guns.

DETAILED DESCRIPTION OF THE DRAWINGS AND OPERATION OF THE INVENTION

Turning now to the drawings, for a complete understanding of the invention, gun cylinder lock device 10 as shown in FIG. 1 has a pair of chamber studs 11 jointed to pawl 12. Chamber studs 11 are elongated and cylindrical in shape and are sized to fit within the shell chambers 17 of revolver 25. The exact length and diameter of chamber studs 11 can vary but it has been found if they penetrate approximately one half ($\frac{1}{2}$) the depth of the chamber opening they perform satisfactory and longer or shorter studs of course may be utilized. Studs 11 are positioned along the bottom side of planar pawl 12 and device 10 may fit two or more revolver sizes for example, device 10 may fit both a 0.32 and a 0.38 caliber pistol. As further shown in FIG. 1 pawl 12 is semi-hexagonally shaped with upper pawl section 13, lower pawl section 14 and central pawl section 15 therebetween. As both upper section 13 and lower pawl section 14 are angularly disposed to central pawl section 15 a semi-hexagonally shaped pawl is formed.

Figure 3:
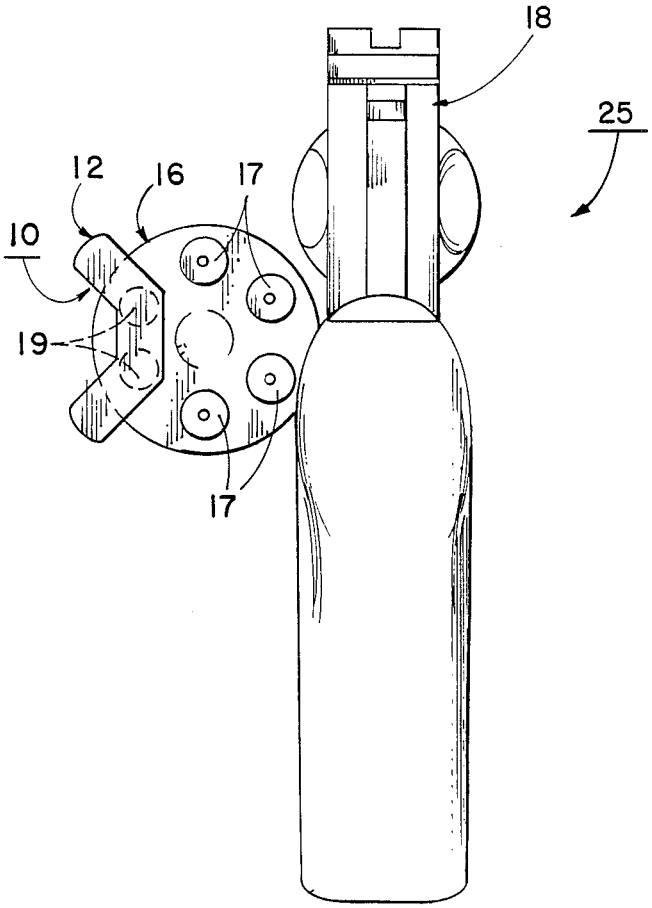
FIG. 3 illustrates a rear view of a typical revolver having the cylinder lock device positioned within the open cylinder.
Figure 4:
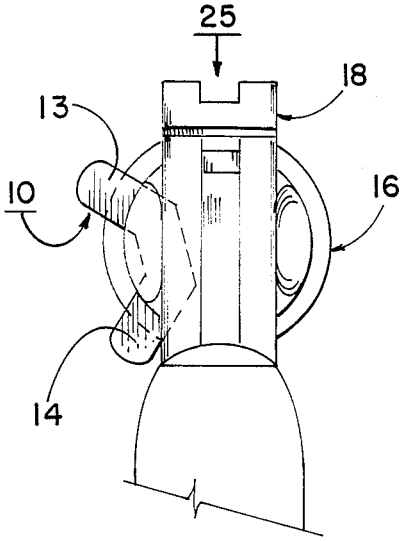
FIG. 4 demonstrates a rear view of the revolver of FIG. 3 with the pawl contacting the frame of the revolver as would occur if firing of the gun were attempted.

As seen in FIG. 4, if the trigger (not shown) of revolver 25 is pulled, cylinder 16 indexes in a counter clockwise direction causing lower pawl section 14 to strike frame 18 along the lower portion of frame 18 and prevents revolver 25 from firing. As illustrated in FIG. 3, with cylinder 16 opened from frame 18, lock device 10 can be easily slid from cylinder 16 by mere finger pressure and two (2) additional shell cartridges can then be placed within the empty shell chambers. Lock device 10 easily slides inwardly and outwardly from gun cylinder 16 when it is opened as depicted in FIG. 3 and once cylinder 16 is closed as in FIG. 4, lock device 10 cannot be removed as long as cylinder 16 remains in a closed posture.

As would be realized from FIG. 4, upper pawl section 13 and lower pawl section 14 both extend beyond the periphery of cylinder 16 so that lock device 10 can be easily gripped and removed as required.

Figure 5:
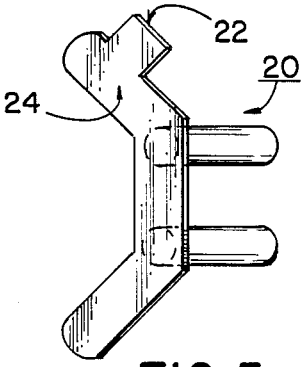
FIG. 5 depicts a second embodiment of the invention with a pawl tab.

Another embodiment of the invention is seen in FIG. 5 in which lock device 20 includes planar rectangularly shaped tab 22 affixed to the inside edge of upper pawl section 24. Tab 22 may be needed to insure that certain gun cylinders will not rotate and fire and to insure that lock device 20 is positioned properly when the gun cylinder is closed.

Modifications and changes can be made to the present invention without departing from its intended scope and the illustrations and examples presented herein are for explanatory purposes and are not to be construed as limitations to the appended claims.

I claim:

1. A cylinder lock device for a gun cylinder comprising: a chamber stud, a pawl, said pawl connected to said chamber stud, said pawl having a radial section, said radial section extending outwardly beyond said cylinder when said chamber stud is positioned in a cylinder chamber whereby said radial section will stop the cylinder rotation to prevent the gun from firing.

2. A cylinder lock as claimed in claim 1 wherein said chamber stud comprises a cylindrical member.

3. A cylinder lock as claimed in claim 1 wherein said pawl comprises a planar member.

4. A cylinder chamber as claimed in claim 3 wherein said planar member is arcuately shaped.

5. A cylinder lock as claimed in claim 1 wherein said pawl is semi-hexagonally shaped.

6. A cylinder lock as claimed in claim 1 and including a pair of chamber studs.

7. A cylinder lock as claimed in claim 1 and including a pawl tab, said tab affixed to said pawl.

8. A lock for a rotating gun cylinder, said cylinder positioned within a frame to prevent the cylinder from adequately rotating while the cylinder is closed comprising: semi-hexagonally shaped planar pawl, said pawl including a radial section, a pair of cylinder studs, said studs being elongated and spaced along one side of said planar pawl near the middle thereof so each stud will fit into separate shell chambers of the cylinder and said radial section will extend beyond the periphery of the cylinder whereby said radial section, will contact the cylinder frame and stop the cylinder rotation thereby preventing the gun from firing.

9. A cylinder lock for use with a gun having a rotatable cylinder with shell chamber therein comprising: a planar pawl, said pawl having an upper radially extending section, a central section and a lower radially extending section, said upper and lower sections joined to said central sections, a cylinder stud, said stud attached to said pawl, said stud for positioning within a shell chamber, said upper and said lower section extending beyond the periphery of said cylinder when said cylinder stud is positioned within a shell chamber, whereby said pawl will prevent sufficient cylinder rotation to allow the gun to fire.

* * * * *

UNITED STATES PATENT AND TRADEMARK OFFICE

CERTIFICATE OF CORRECTION

PATENT NO. : 4,802,298

DATED : 07 February 1989

INVENTOR(S) : Ronald G. Baugus

It is certified that error appears in the above-identified patent and that said Letters Patent is hereby corrected as shown below: On the title page The inventor's name should be corrected to:

Ronald G. Baugus

Signed and Sealed this

Twentieth Day of June, 1989

*Attest:*

DONALD J. QUIGG

*Attesting Officer*

*Commissioner of Patents and Trademarks*